United States Patent [19]

Rossanigo

[11] Patent Number: 4,942,821

[45] Date of Patent: Jul. 24, 1990

[54] TAMPING MACHINE, PARTICULARLY FOR RAILROAD BALLASTS

[75] Inventor: Cesare Rossanigo, Bassignana, Italy

[73] Assignee: So.Re.Ma. Operatrici Ferroviarie Snc di Cesare Rossanigo & C., Bassignana, Italy

[21] Appl. No.: 313,414

[22] Filed: Feb. 21, 1989

[30] Foreign Application Priority Data

Mar. 9, 1988 [IT] Italy ..... 67194 A/88

[51] Int. Cl.[5] ..... E01B 27/16

[52] U.S. Cl. ..... 104/12

[58] Field of Search ..... 104/10, 11, 12, 13, 104/14; 81/463, 465

[56] References Cited

U.S. PATENT DOCUMENTS

| | | | |
|---|---|---|---|
| 3,292,558 | 12/1966 | Oville | 104/10 |
| 3,608,498 | 9/1971 | Plasser | 104/12 |
| 4,090,451 | 5/1978 | Theurer | 104/10 |
| 4,096,806 | 6/1978 | Allmer | 104/12 |
| 4,312,275 | 1/1982 | Theurer et al. | 104/12 |

FOREIGN PATENT DOCUMENTS

| | | | |
|---|---|---|---|
| 1158645 | 5/1985 | U.S.S.R. | 104/12 |
| 2096215 | 10/1982 | United Kingdom | 104/10 |

*Primary Examiner*—Andres Kashnikow
*Assistant Examiner*—Mark T. Le
*Attorney, Agent, or Firm*—Guido Modiano; Albert Josif

[57] ABSTRACT

The machine comprises at least two pairs of vibrating tamping hammers, each rigidly associated with a support oscillably pivoted to the frame of the machine and subject to the action of a fluidodynamic actuation jack comprising a first extendable section, adapted to move the hammer from a substantially vertical working position to a substantially horizontal lowered idle position, and a second section, fed by distribution mechanism with alternating cyclic operation, adapted to subject said first jack section and the related tamping hammer to a corresponding cyclic and alternating vibration.

37 Claims, 4 Drawing Sheets

Fig. 1
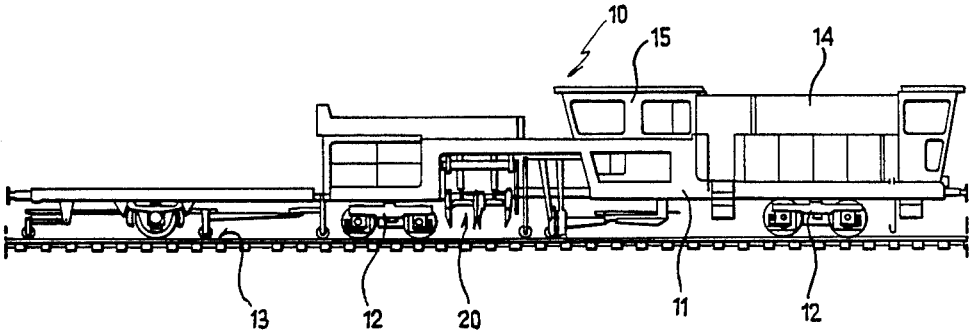
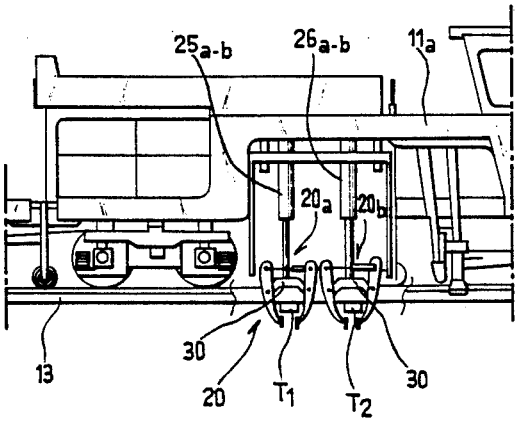
Fig. 2
Fig. 3
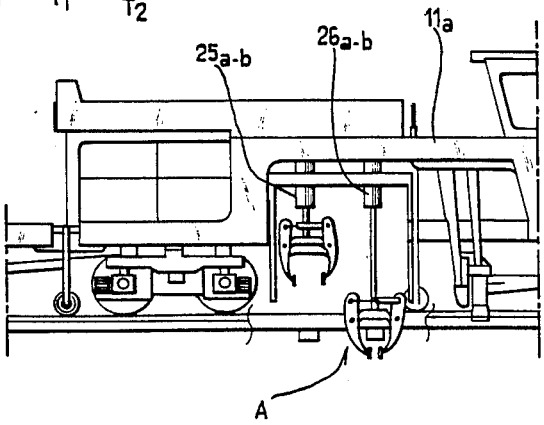

TAMPING MACHINE, PARTICULARLY FOR RAILROAD BALLASTS

BACKGROUND OF THE INVENTION

The present invention relates to an improved tamping machine, particularly for regenerating railroad ballasts.

Trailer or self-propelled railcars, bearing groups of tamping machines arranged inside and outside each rail according to patterns known to the technician in the field and termed single- or twin-head, are usually employed to regenerate railroad ballasts. Each tamping machine generally has two pairs of vibrating hammers which are sunk into the ballast on one side and on the other of each tie to move the rubble constituting the ballast and tamp said tie with it.

In order to vibrate the hammers and sink them into the rubble, currently known tamping machines use mechanical systems essentially of the eccentric-mass or crank type. Such mechanical systems have many disadvantages, and chiefly: a considerable structural complexity arising from the high stresses transmitted to the various elements of the machine and the need to keep the vibration frequency of the hammers within relatively modest limits, both to contain the above mentioned stresses within acceptable limits and to limit power consumption.

In known machines, the vibration is furthermore simultaneously transmitted to all the pairs of hammers of each "head", where the term "head" indicates the set of elements acting on each tie.

This circumstance constitutes a considerable disadvantage, as it forces the outfitting of two different types of railcar, respectively for line work and for switch work. The first is of the twin-head type and can operate simultaneously on two ties, while the second necessarily has a single head and therefore its use for line work has an unacceptable performance, thus requiring the outfitting of differentiated railcars respectively for lines and switches.

SUMMARY OF THE INVENTION

The aim of the present invention is essentially to eliminate these disadvantages.

In particular, an important aim of the present invention is to provide a tamping machine with a significantly simplified structure, adapted to operate with frequencies variable within a wide range of values selectable according to the state of the ballast to be regenerated and in any case adapted to operate at markedly higher frequencies with respect to those of known mechanical systems, without generating intolerable structural stresses to the advantage of a considerable increase in performance.

Another important object of the present invention is to provide a tamping machine having limited dimensions and weight and therefore adapted to outfit railcars with reduced weights and dimensions.

A further important object of the present invention is to provide an improved tamping machine adapted to outfit a single type of railcar for working both on line and on switches, with evident advantages in management economy and maintenance and with a considerable reduction in the operative execution times since the replacement of line cars with switch cars and vice versa is avoided during work.

This aim and these objects as well as others which will become apparent from the following detailed description, are achieved by a tamping machine, particularly for regenerating railroad ballasts, characterized in that it comprises at least two pairs of vibrating tamping hammers, each rigidly associated with a support oscillably pivoted to the frame of the machine and subject to the action of a fluidodynamic actuation jack comprising a first extendable section, adapted to move the hammer from a substantially vertical working position to a substantially horizontal lowered idle position, and a second vibrating section, fed by distribution means with alternating cyclic operation, adapted to subject said first jack section and the related tamping hammer to a corresponding cyclic and alternated vibration.

BRIEF DESCRIPTION OF THE DRAWINGS

Further characteristics and advantages of the invention will become apparent from the following detailed description and with reference to the accompanying drawings, given by way of non-limitative example, wherein:

FIG. 1 is an elevation view of a railcar equipped with tamping machines according to the present invention;

FIGS. 2 and 3 are partial and enlarged-scale elevation views, similar to FIG. 1, illustrating the arrangement of the tamping machines in operating conditions for line work and for switch work respectively;

DESCRIPTION OF THE PREFERRED EMBODIMENTS

Figure 4:
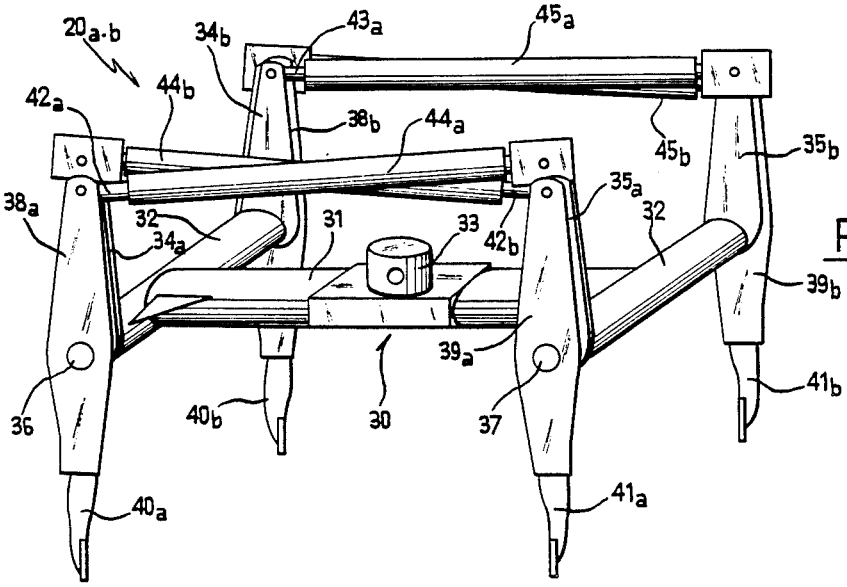
FIG. 4 is a schematic perspective view of the tamping machine according to the present invention with the pairs of hammers in working position.

In the drawings, the reference numeral 10 indicates a railcar having a frame 11 mounted on gears 12 which rest on the track 13 to be regenerated. A group of tamping machines 20 and a generator unit (not illustrated) composed of a Diesel motor and of one or more hydraulic pumps with related fuel and hydraulic-fluid tanks are mounted on the railcar; the generator unit is accommodated in a housing 14 adjacent to a driver's cab 15.

The group of tamping machines 20 is formed by four units 20*a*–20*b*, accommodated at the center of the railcar and aligned in pairs at two adjacent and consecutive ties T1–T2 of the ballast.

The frame 10 has an arched raised portion 11*a* at the group of machines 20; pairs of fluidodynamic jacks 25*a*–25*b*, 26*a*–26*b* arranged transversely side by side extend downwards from said portion. The frame 30 of a corresponding tamping machine is suspended from each jack stem; the jacks allow to simultaneously lift all the machines, for example to transfer the railcar, as illustrated in FIG. 1; to lower all the machines to their working position, as shown in FIG. 2, which allows to use the railcar for line work; to selectively lower one or more machines, as indicated by A in FIG. 3, to use the railcar on switches or for other applications arising from particular requirements of the work on the ballast. Besides the above described purposes, the jacks 25–26 are preset to impart to the machines the thrust required to drive the tamping elements into the ballast, as described hereinafter.

Figure 5:
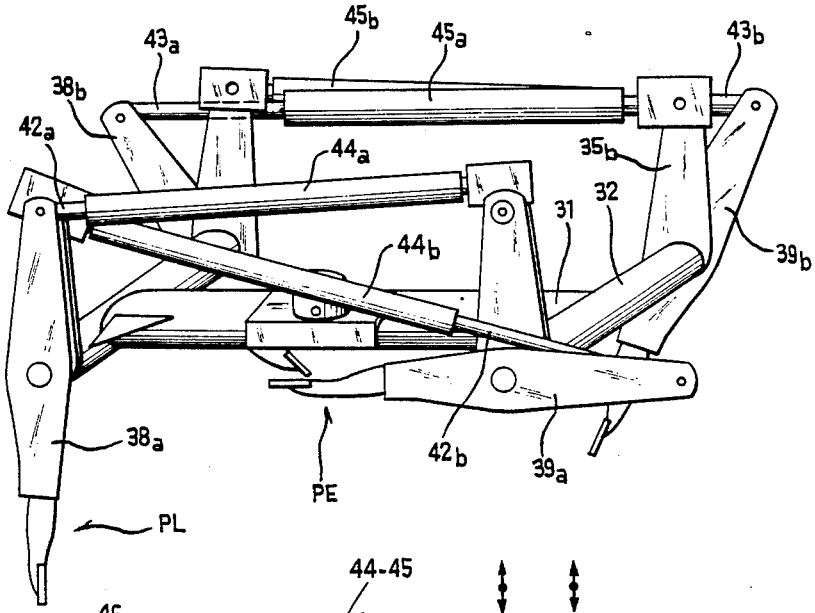
FIG. 5 is an isometric view, similar to FIG. 1, illustrating the manner of folding of the hammers in their idle position.
Figure 5A:
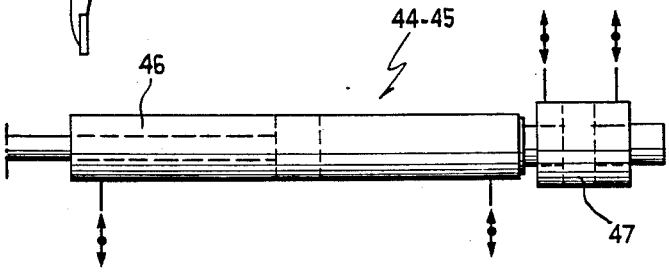
FIG. 5*a* is an enlarged-scale view of a detail of FIG. 4.

As shown in FIGS. 4 and 5, each tamping machine which compose the group indicated by 20 is substantially constituted by a sturdy frame 30 in the shape of a double T, preferably in steel tube, comprising a longitudinal member 31 and two cross-members 32. The longitudinal member 31 has 5 a central sleeve 33 for coupling with the stem of the corresponding suspension jack 25; the cross-members 32 have, at their ends, pairs of rigid arms **34*a*–34*b*, 35*a*–35*b* which extend upwards. Each cross-member furthermore has end pivots 36, 37 to which opposite pairs of oscillable supports 38*a*–38*b*, 39*a*–39*b* are articulated with bearings (not illustrated) interposed, to said end pivots: each oscillable support bears a corresponding tamping hammer 40*a*–40*b*, 41*a*–41*b***.

The end of each oscillable support 38–39 which is opposite to the end bearing the hammer is articulated to the stem **42*a*–42*b*, 43*a*–43*b* of a corresponding fluidodynamic actuation jack 44*a*–44*b*, 45*a*–45*b*; the cylinders of said jacks are articulated to the corresponding rigid arm of the opposite cross-member; the jack 44*a* is therefore inserted, with its axis substantially horizontal, between the oscillable support 38*a* and the arm 35*a*, the jack 44*b* is inserted between the support 39*a* and the arm 34*a***, and so on.

As clearly illustrated in FIG. **5*a*, each jack 44–45 is formed by a first extendable section 46 and by a second vibrating section 47. The first section is extendable and is preset to move the corresponding tamping hammer 40–41 from a substantially vertical working position, indicated by PL in FIG. 5**, to a substantially horizontal lowered idle position indicated by PE in said figure.

The second section can vibrate and is adapted to subject the first section, and the respective hammer connected thereto, to a cyclic and alternating working vibration which can be varied in frequency as will be specified hereinafter. The second vibrating section is arranged mechanically in series to the first section, the stem of the second section being rigidly connected to the cylinder of the first section. The sections of each jack are separately fed by corresponding hydraulic circuits connected to said generator unit; the first extendable section is fed by means of a corresponding feed-discharge distribution valve actuatable by the operator to exclude one or more hammers of each machine when required by the layout of the track; the second one is fed by means of feed-discharge distribution valves controlled in cyclic sequence by one or more distribution means.

Figure 6:
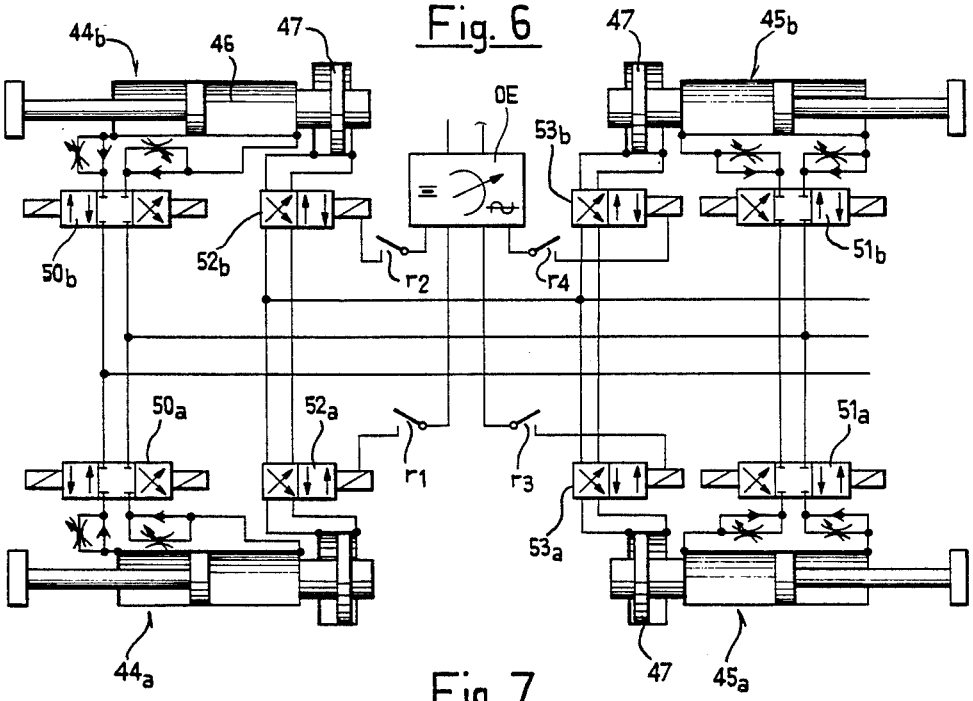
FIG. 6 is a diagram of a hydraulic feed circuit for the first and second sections of the hammer actuation jacks.

The diagram of FIG. 6 illustrates a hydraulic circuit adapted for that purpose.

According to said diagram, the first section 46 of each jack 44–45 is fed by the motor-pump generator unit by means of corresponding electric distribution valves **50*a*–50*b*, 51*a*–51*b* with intermediate locking positions, the solenoids whereof are subject to corresponding selective energization actuations, for example by means of a lever, arranged in the driver's cab 15. This allows the operator to extend or retract the extendable section of each jack and consequently lower into working position or exclude each hammer of the tamping machine, arranged in operative position as illustrated in FIG. 3**.

The railcar 10, which is usable for line or switch work depending on the position of the tamping machines, furthermore allows, in the switch configuration, to selectively operate with one or two pairs of hammers for each machine, and even, if required, with a single hammer; this gives said railcar unprecedented flexibility in use and rapidity in operation.

In the intermediate locking position, illustrated in the figure, the electric valves 50–51 cut off all the feed and discharge ducts of the corresponding jack section, mutually rigidly associating the stem and the cylinder of said jack.

The second section 47 of each jack is fed by means of corresponding electric distribution valves **52*a*–52*b*, 53*a*–53*b*** of the two-way type with no locking position, and the solenoids of said electric valves are cyclically energized by an oscillator OE with variable frequency preferably of the electronic type.

As clearly illustrated in FIG. 6, contacts r1-r2-r3-r4 of corresponding exclusion relays correlated to the electric distribution valves 50–51 are inserted between the solenoids of the valves and the feed oscillator OE; said contacts are opened to cut off the hydraulic feed to said second section of each jack when the corresponding first section is extended to raise the respective tamping hammer to its idle position.

Figure 7:
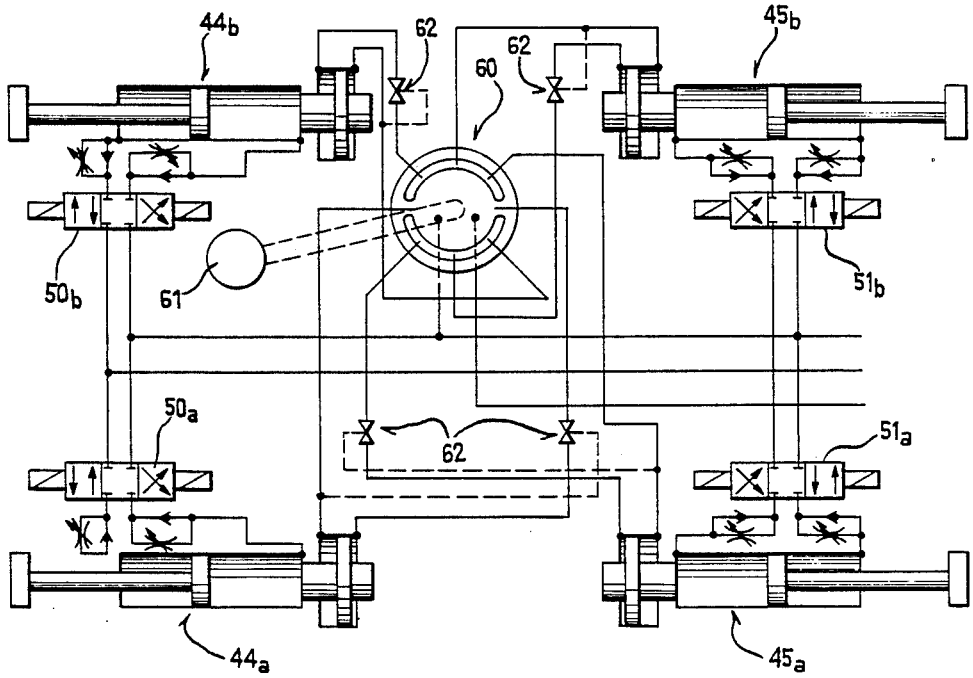
FIG. 7 is a diagram, similar to FIG. 6, of a variated embodiment of the circuit.

The circuit illustrated in FIG. 7 differs from the one of FIG. 6 in that the electric distribution valves 52–53 are replaced by a rotating mechanical distributor 60 actuated by an adjustable-speed electric motor 61. In this case bypass electric valves 62, also correlated to the electric valves 50–51, are provided for the above described exclusion function.

Figure 8:
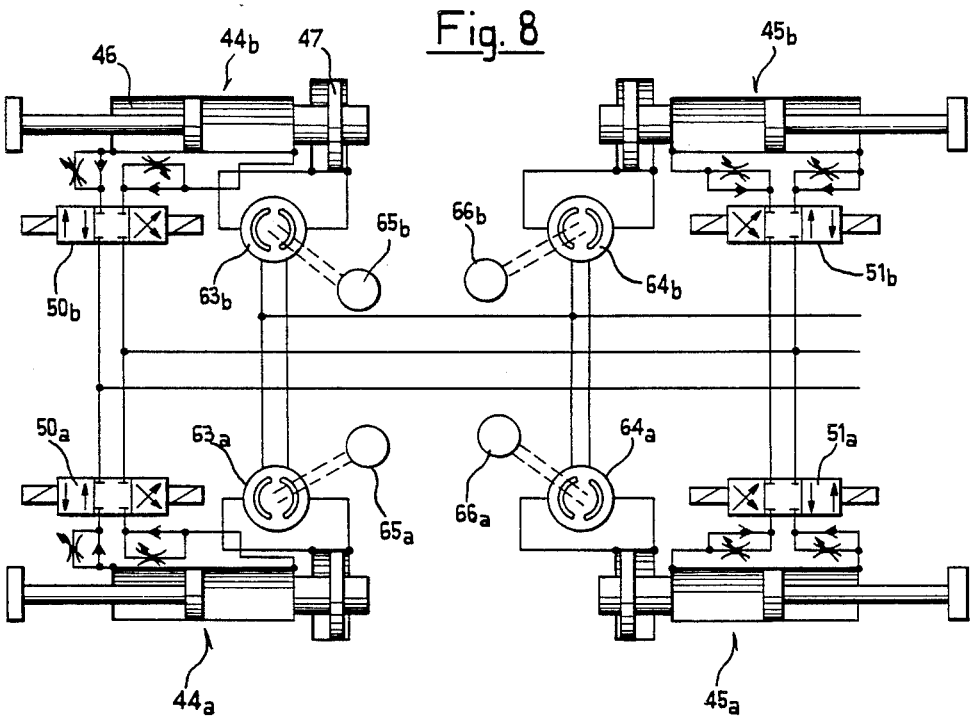
FIG. 8 is a diagram, similar to FIG. 6, of another variated embodiment of the circuit.

In the variated embodiment of FIG. 8, the second vibrating section 47 of each jack is fed by its own rotary distribution valve **63*a*–63*b*, 64*a*–64*b* actuated by a corresponding motor 65*a*–65*b*, 66*a*–66*b* according to an arrangement which avoids the insertion of the bypass valves 62** and allows to independently vary the working frequency of each hammer.

Figure 9:
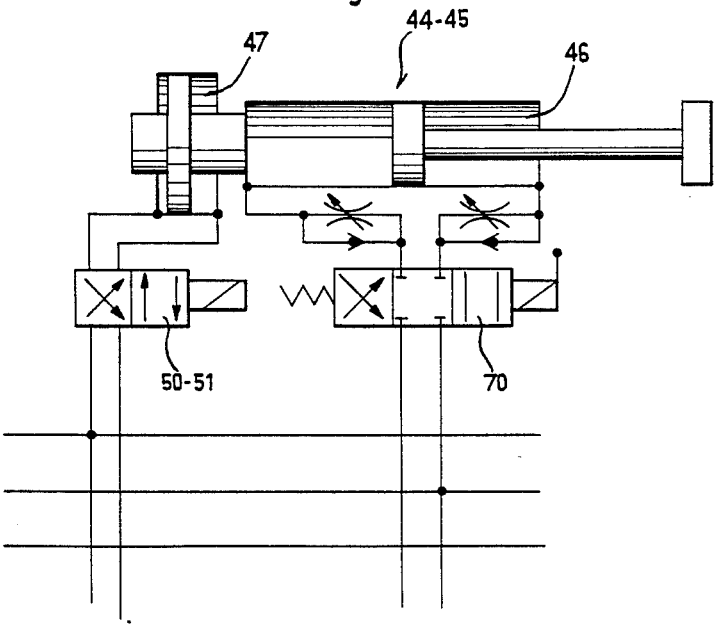
FIG. 9 is an enlarged-scale detail view of the diagrams of FIGS. 6 to 8, illustrating another constructive variated embodiment of said circuit.

The variated embodiment of FIG. 9 differs from what has been described above in that the electric distribution valves 50–51 are replaced with manually actuated distribution valves 70.

The details of execution and the embodiments may be extensively varied with respect to what is described and illustrated only by way of non-limitative example without thereby abandoning the scope of the invention and without altering the concept of the invention.

I claim:

1. Tamping machine, particularly for regenerating railroad ballasts, comprising a frame, at least two pairs of vibrating tamping hammers, at least two pairs of supports, at least two pairs of fluidodynamic actuation jacks, distribution means with alternating cyclic operation, each one of said tamping hammers being rigidly connected to one of said supports, each one of said supports being pivotally connected to said frame, each one of said fluidodynamic actuation jacks being pivotally connected to one of said supports, each one of said fluidodynamic actuation jacks having a first extendable section and a second section, said distribution means feeding each said second section of each one of said fluidodynamic actuation jacks, said tamping machine further comprising first fluidodynamic actuation means and second fluidodynamic means, whereby said distribution means cause said tamping hammers to vibrate cyclically and alternatingly, said first fluidodynamic actuation means selectively and controllably cause each said first extendable section of each one of said fluidodynamic actuation jacks to expand and contract, thereby selectively and controllably moving each one of said tamping hammers between a substantially vertical working position and a substantially horizontal idle position, said second fluidodynamic means selectively cut off said distribution means to a respective said second section when a corresponding one of said tamping hammers is in idle position.

2. Tamping machine according to claim 1, wherein said first extendable section and said second section of each one of said fluidodynamic actuation jack are mechanically connected in series.

3. Tamping machine according to claim 1, further comprising a suspension jack and coupling means, said coupling means connecting said suspension jack to said frame, said suspension jack being adapted to move said tamping machine between a raised non-working position and a lowered working position.

4. Tamping machine according to claim 1, wherein said frame comprises a longitudinal member and two cross-members, said longitudinal member being rigidly connected to each one of said cross-members, thereby forming the shape of a double T, said frame further comprises two pairs of rigid arms and two pairs of end pivots, one pair of said rigid arms being connected to one of said cross-members and another pair of said rigid arms being connected to another of said cross-members, one pair of said end pivots pivotally connecting two of said supports to one of said cross-members and another pair of said end pivots pivotally connecting another two of said supports to another of said cross-members, each of said fluidodynamic actuation jacks being substantially horizontal, each of said fluidodynamic actuation jacks being connected to one of said supports and to one of said rigid arms arranged opposite to said one of said supports.

5. Tamping machine according to claim 1, wherein said first fluidodynamic actuation means comprise at least two pairs of electric distribution valves, each one of said electric distribution valves being connected to one said first extendable section of each one of said fluidodynamic actuation jacks, each one of said electric distribution valves having an intermediate locking position and a solenoid, each said solenoid being subjected to manually operated energization actuations.

6. Tamping machine according to claim 2, wherein said distribution means comprise at least two pairs of two-way type electric distribution valves, each one of said two-way type electric distribution valves being connected to one said second section of each one of said fluidodynamic actuation jacks, each one of said two-way type electric distribution valves being a solenoid, each said solenoid being cyclically energized by a variable-frequency oscillator.

7. Tamping machine according to claim 6, wherein said second fluidodynamic means comprise at least two pairs of exclusion relays, each one of said exclusion relays being inserted between each said solenoid of each one of said two-way type electric distribution valves and said variable-frequency oscillator.

8. Tamping machine according to claim 1, wherein said distribution means comprise a rotating mechanical distributor and an adjustable-speed electric motor, said rotating mechanical distributor being actuated by said adjustable-speed electric motor, said rotating mechanical distributor being connected to each said second section of each one of said fluidodynamic actuation jacks, and wherein said second fluidodynamic means comprise at least two pairs of bypass electric valves, each one of said bypass electric valves being inserted between each said second section of each one of said fluidodynamic actuation jacks and said rotating mechanical distributor.

9. Tamping machine according to claim 1, wherein said distribution means comprise at least two pairs of rotating mechanical distributors and at least two pairs of adjustable-speed electric motors, each one of said rotating mechanical distributors being actuated by one of said adjustable-speed electric motors, each one of said rotating mechanical distributors being connected to one said second section of each one of said fluidodynamic actuation jacks.

10. Tamping machine according to claim 1, wherein said first fluidodynamic actuation means comprise at least two pairs of manually actuated distribution valves, each one of said manually actuated distribution valves being connected to one said first extendable section of each one of said fluidodynamic actuation jacks.

11. Tamping machine, particularly for regenerating railroad ballasts, comprising a frame, at least two pairs of vibrating tamping hammers, at least two pairs of supports, at least two pairs of fluidodynamic actuation jacks, distribution means with alternating cyclic operation, each one of said tamping hammers being rigidly connected to one of said supports, each one of said supports being pivotally connected to said frame, each one of said fluidodynamic actuation jacks being pivotally connected to one of said supports, each one of said fluidodynamic actuation jacks having a first extendable section and a second section, said distribution means feeding each said second section of each one of said fluidodynamic actuation jacks, said frame comprising a longitudinal member and two cross-members, said longitudinal member being rigidly connected to each one of said cross-members, thereby forming the shape of a double T, said frame further comprises two pairs of rigid arms and two pairs of end pivots, one pair of said rigid arms being connected to one of said cross-members and another pair of said rigid arms being connected to another of said cross-members, one pair of said end pivots pivotally connecting two of said supports to one of said cross-members and another pair of said end pivots pivotally connecting another two of said supports to another of said cross-members, each of said fluidodynamic actuation jacks being substantially horizontal, each of said fluidodynamic actuation jacks being connected to one of said supports and to one of said rigid arms arranged opposite to said one of said supports, whereby said distribution means cause said tamping hammers to vibrate cyclically and alternatingly.

12. Tamping machine according to claim 11, further comprising first fluidodynamic actuation means and second fluidodynamic means, whereby said first fluidodynamic actuation means selectively and controllably cause each said first extendable section of each one of said fluidodynamic actuation jacks to expand and contract, thereby selectively and controllably moving each one of said tamping hammers between a substantially vertical working position and a substantially horizontal idle position, said second fluidodynamic means selectively cut off said distribution means to a respective said second section when a corresponding one of said tamping hammers is in idle position.

13. Tamping machine according to claim 11, wherein said first extendable section and said second section of each one of said fluidodynamic actuation jacks are mechanically connected in series.

14. Tamping machine according to claim 11, further comprising a suspension jack and coupling means, said coupling means connecting said suspension jack to said frame, said suspension jack being adapted to move said tamping machine between a raised non-working position and a lowered working position.

15. Tamping machine according to claim 12, wherein said first fluidodynamic means comprise at least two pairs of electric distribution valves, each one of said electric distribution valves being connected to one said first extendable section of each one of said fluidodynamic actuation jacks, each one of said electric distribution valves having an intermediate locking position and a solenoid, each said solenoid being subjected to manually operated energization actuations.

16. Tamping machine according to claim 12, wherein said distribution means comprise at least two pairs of two-way type electric distribution valves, each one of said two-way type electric distribution valves being connected to one said second section of each one of said fluidodynamic actuation jacks, each one of said two-way type electric distribution valves having a solenoid, each said solenoid being cyclically energized by a variable-frequency oscillator, and wherein said second fluidodynamic means comprise at least two pairs of exclusion relays, each one of said exclusion relays being inserted between each said solenoid of each one of said two-way type electric distribution valves and said variable-frequency oscillator.

17. Tamping machine according to claim 12, wherein said distribution means comprise a rotating mechanical distributor and an adjustable-speed electric motor, said rotating mechanical distributor being actuated by said adjustable-speed electric motor, said rotating mechanical distributor being connected to each said second section of each one of said fluidodynamic actuation jacks, and wherein said second fluidodynamic means comprise at least two pairs of bypass electric valves, each one of said bypass electric valves being inserted between each said second section of each one of said fluidodynamic actuation jacks and said rotating mechanical distributor.

18. Tamping machine according to claim 11, wherein said distribution means comprise at least two pairs of rotating mechanical distributors and at least two pairs of adjustable-speed electric motors, each one of said rotating mechanical distributors being actuated by one of said adjustable-speed electric motors, each one of said rotating mechanical distributors being connected to one said second section of each one of said fluidodynamic actuation jacks.

19. Tamping machine according to claim 12, wherein said first fluidodynamic actuation means comprise at least two pairs of manually actuated distribution valves, each one of said manually actuated distribution valves being connected to one said first extendable section of each one of said fluidodynamic actuation jacks.

20. Tamping machine, particularly for regenerating railroad ballasts, comprising a frame, at least two pairs of vibrating tamping hammers, at least two pairs of supports, at least two pairs of fluidodynamic actuation jacks, distribution means with alternating cyclic operation, second fluidodynamic means, each one of said tamping hammers being rigidly connected to one of said supports, each one of said supports being pivotally connected to said frame each one of said fluidodynamic actuation jacks being pivotally connected to one of said supports, each one of said fluidodynamic actuation jacks having a first extendable section and a second section, said distribution means feeding each said second section of each one of said fluidodynamic actuation jacks, said distribution means comprise at least two pairs of two-way type electric distribution valves, each one of said two-way type electric distribution valves being connected to one said second section of each one of said fluidodynamic actuation jacks, each one of said two-way type electric distribution valves having a solenoid, each said solenoid being cyclically energized by a variable-frequency oscillator, said second fluidodynamic means comprise at least two pairs of exclusion relays, each one of said exclusion relays being inserted between each said solenoid of each one of said two-way type electric distribution valves and said variable-frequency oscillator, whereby said distribution means cause said tamping hammers to vibrate cyclically and alternatingly, and whereby said second fluidodynamic means selectively cut off said distribution means to a respective said second section when a corresponding one of said tamping hammers is in idle position.

21. Tamping machine according to claim 20, further comprising first fluidodynamic actuation means, whereby said first fluidodynamic actuation means selectively and controllably cause each said first extendable section of each one of said fluidodynamic actuation jacks to expand and contract, thereby selectively and controllably moving each one of said tamping hammers between a substantially vertical working position and a substantially horizontal idle position.

22. Tamping machine according to claim 20, wherein said first extendable section and said second section of each one of said fluidodynamic actuation jacks are mechanically connected in series.

23. Tamping machine according to claim 20, further comprising a suspension jack and coupling means, said coupling means connecting said suspension jack to said frame, said suspension jack being adapted to move said tamping machine between a raised non-working position and a lowered working position.

24. Tamping machine according to claim 20, wherein said frame comprises a longitudinal member and two cross-members, said longitudinal member being rigidly connected to each one of said cross-members, thereby forming the shape of a double T, said frame further comprises two pairs of rigid arms and two pairs of end pivots, one pair of said rigid arms being connected to one of said cross-members and another pair of said rigid arms being connected to another of said cross-members, one pair of said end pivots pivotally connecting two of said supports to one of said cross-members and another pair of said end pivots pivotally connecting another two of said supports to another of said cross-members, each of said fluidodynamic actuation jacks being substantially horizontal, each of said fluidodynamic actuation jacks being connected to one of said supports and to one of said rigid arms arranged opposite to said one of said supports.

25. Tamping machine according to claim 21, wherein said first fluidodynamic actuation means comprise at least two pairs of electric distribution valves, each one of said electric distribution valves being connected to one said first extendable section of each one of said fluidodynamic actuation jacks, each one of said electric distribution valves having an intermediate locking position and a solenoid, each said solenoid being subjected to manually operated energization actuations.

26. Tamping machine according to claim 20, wherein said distribution means comprise a rotating mechanical distributor and an adjustable-speed electric motor, said rotating mechanical distributor being actuated by said adjustable-speed electric motor, said rotating mechanical distributor being connected to each said second section of each one of said fluidodynamic actuation jacks, and wherein said second fluidodynamic means comprise at least two pairs of bypass electric valves, each one of said bypass electric valves being inserted between each said second section of each one of said fluidodynamic actuation jacks and said rotating mechanical distributor.

27. Tamping machine according to claim 20, wherein said distribution means comprise at least two pairs of rotating mechanical distributors and at least two pairs of adjustable-speed electric motors, each one of said rotating mechanical distributors being actuated by one of said adjustable-speed electric motors, each one of said rotating mechanical distributors being connected to one said second section of each one of said fluidodynamic actuation jacks.

28. Tamping machine according to claim 21, wherein said first fluidodynamic actuation means comprise at least two pairs of manually actuated distribution valves, each one of said manually actuated distribution valves being connected to one said first extendable section of each one of said fluidodynamic actuation jacks.

29. Tamping machine, particularly for regenerating railroad ballasts, comprising:

a frame, a plurality of supports, each one of said supports being pivotally connected to said frame, a plurality of vibrating hammers, each one of said vibrating hammers being rigidly connected to one of said supports, a plurality of fluidodynamic vibrating sections, wherein said tamping machine further comprises a plurality of fluidodynamic extendable sections, each one of said fluidodynamic extendable sections being connected in series with one of said fluidodynamic vibrating sections, a plurality of actuation members being defined by each one of said fluidodynamic extendable sections connected with one of said fluidodynamic vibrating sections, each one of said actuation members being connected at one end thereof to one of said supports and being connected at another end thereof to said frame, said tamping machine further comprises first fluidodynamic actuation means and distribution means with alternating cyclic operation, said first fluidodynamic means feed said plurality of said fluidodynamic extendable sections, said distribution means feed said plurality of fluidodynamic vibrating sections, whereby each one of said tamping hammers is subjected to a cyclic and alternated vibration by said fluidodynamic vibrating sections, and whereby said first fluidodynamic actuation means selectively and controllably cause each one of said fluidodynamic extendable sections to expand and contract, thereby selectively and controllably moving each one of said tamping hammers between a substantially vertical working position and a substantially horizontal idle position.

30. Tamping machine according to claim 29, further comprising second fluidodynamic means, said second fluidodynamic means selectively cut off said distribution means to a respective one of said fluidodynamic vibrating sections when a corresponding one of said tamping hammers is in idle position.

31. Tamping machine according to claim 29, further comprising a suspension jack and coupling means, said coupling means connecting said suspension jack to said frame, said suspension jack being adapted to move said tamping machine between a raised non-working position and a lowered working position.

32. Tamping machine according to claim 29, wherein said frame comprises a longitudinal member and two cross-members, said longitudinal member being rigidly connected to each one of said cross-members, thereby forming the shape of a double T, said frame further comprises two pairs of rigid arms and two pairs of end pivots, one pair of said rigid arms being connected to one of said cross-members and another pair of said rigid arms being connected to another of said cross-members, one pair of said end pivots pivotally connecting two of said supports to one of said cross-members and another pair of said end pivots pivotally connecting another two of said supports to another of said cross-members, each one of said actuation members being substantially horizontal, each one of said actuation members being connected to one of said supports and to one of said rigid arms arranged opposite to said one of said supports.

33. Tamping machine according to claim 29, wherein said first fluidodynamic actuation means comprise at least two pairs of electric distribution valves, each one of said electric distribution valves being connected to one of said fluidodynamic extendable sections, each one of said electric distribution valves having an intermediate locking position and a solenoid, each said solenoid being subjected to manually operated energization actuation.

34. Tamping machine according to claim 30, wherein said distribution means comprise at least two pairs of two-way type electric distribution valves, each one of said two-way type electric distribution valves being connected to one of said vibrating sections, each one of said two-way type electric distribution valves having a solenoid, each said solenoid being cyclically energized by a variable-frequency oscillator, and wherein said second fluidodynamic means comprise at least two pairs of exclusion relays, each one of said exclusion relays being inserted between each said solenoid of each one of said two-way type electric distribution valves and said variable-frequency oscillator.

35. Tamping machine according to claim 30, wherein said distribution means comprise a rotating mechanical distributor and an adjustable-speed electric motor, said rotating mechanical distributor being actuated by said adjustable-speed electric motor, said rotating mechanical distributor being connected to each one of said vibrating sections, and wherein said second fluidodynamic means comprise at least two pairs of bypass electric valves, each one of said bypass electric valves being inserted between each one of said vibrating sections and said rotating mechanical distributor.

36. Tamping machine according to claim 29, wherein said distribution means comprise at least two pairs of rotating mechanical distributors and at least two pairs of adjustable-speed electric motors, each one of said rotating mechanical distributors being actuated by one of said adjustable-speed electric motors, each one of said rotating mechanical distributors being connected to one of said vibrating sections.

37. Tamping machine according to claim 29, wherein said first fluidodynamic actuation means comprise at least two pairs of manually actuated distribution valves, each one of said manually actuated distribution valves being connected to one of said fluidodynamic extendable sections.

* * * * *